United States Patent [19]

Johnson

[11] Patent Number: 4,627,806

[45] Date of Patent: Dec. 9, 1986

[54] APPARATUS FOR THE MANUFACTURE OF FIBROUS WEBS WITH HELICAL ROTOR

[75] Inventor: Jeffrey J. Johnson, Menasha, Wis.

[73] Assignee: James River-Norwalk, Inc., Norwalk, Conn.

[21] Appl. No.: 770,949

[22] Filed: Aug. 30, 1985

[51] Int. Cl.[4] ..... B28B 5/00

[52] U.S. Cl. ..... 425/83.1; 264/114; 264/121; 264/518

[58] Field of Search ..... 425/83.1; 264/121, 518, 264/114; 19/302, 305

[56] References Cited

U.S. PATENT DOCUMENTS

| | | | |
|---|---|---|---|
| 2,931,076 | 4/1960 | Clark | 264/518 |
| 3,644,078 | 2/1972 | Tachibana et al. | 425/83 |
| 3,645,457 | 2/1972 | Greten et al. | 241/60 |
| 3,680,175 | 8/1972 | Kamp et al. | 19/156.3 |
| 3,984,898 | 10/1976 | Matsumura et al. | 19/156.3 |
| 4,144,619 | 3/1979 | White et al. | 19/304 |
| 4,169,699 | 10/1979 | Werner | 425/83.1 |
| 4,264,289 | 4/1981 | Day | 425/83.1 |
| 4,335,066 | 6/1982 | Dinius | 264/121 |
| 4,352,649 | 10/1982 | Jacobsen et al. | 425/83.1 |
| 4,375,447 | 3/1983 | Chung | 264/518 |
| 4,389,175 | 6/1983 | Sakschek | 425/82.1 |

*Primary Examiner*—Donald Czaja
*Assistant Examiner*—Jennifer Cabaniss
*Attorney, Agent, or Firm*—William A. Aguele; Harry W. Hargis, III; Thomas H. Whaley

[57] ABSTRACT

An apparatus for the manufacture of fibrous webs comprises a forming wire and a distributor for depositing dry fibers on the wire. The distributor comprises at least one cylindrical chamber having its axis extending transversely of and in a plane parallel to the wire. The lower semicylindrical wall of the chamber is perforate for distributing fibers on the wire and the upper semicylindrical wall includes a fiber inlet. A helically bladed rotor in the chamber has its axis substantially coincident with the chambers axis of curvature, and upon rotation operates to drive fibers through the screen while evenly distributing them across the wire. Disposition of a pair of chambers in tandem with a common central fiber inlet operates further to create a racetrack fiber distribution across the wire.

6 Claims, 7 Drawing Figures

FIG.1
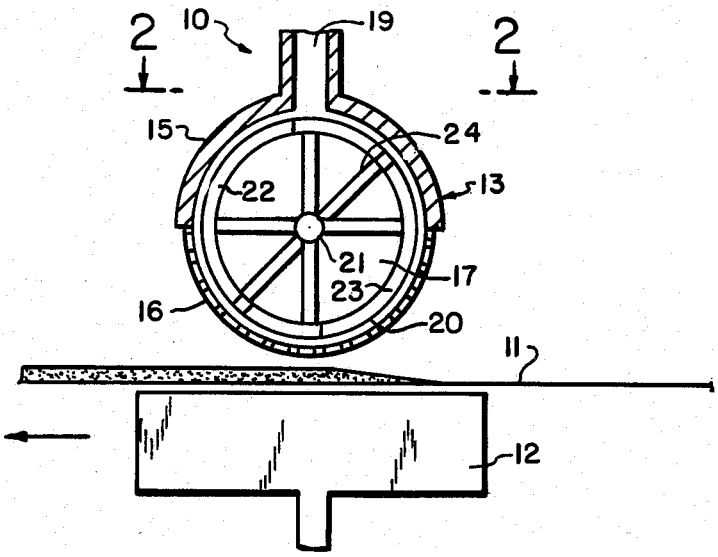
FIG.2
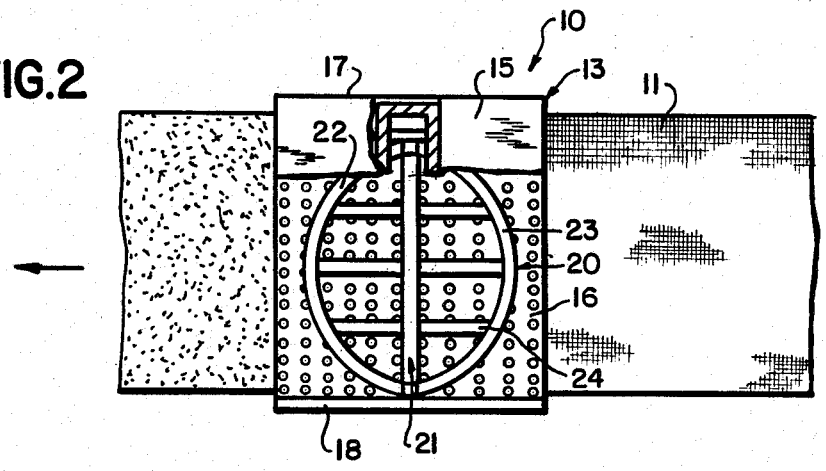
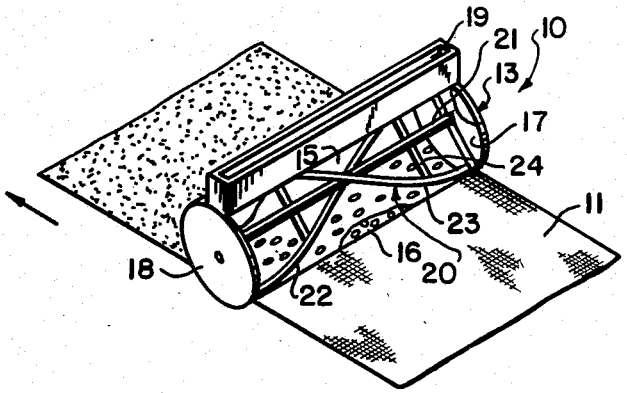
FIG.3

APPARATUS FOR THE MANUFACTURE OF FIBROUS WEBS WITH HELICAL ROTOR

BACKGROUND OF THE INVENTION

This invention relates to the manufacture of fibrous webs, and especially to apparatus for depositing dry fibers from an air suspension thereof onto a moving forming wire to form a fibrous web, such as paper.

Apparatus for depositing dry fibers generally takes the form of a distributor housing having a screen over an outlet opening facing a forming wire, and an inlet opening for directing a suspension of fibers in air from a suitable source into the housing for flow through the screen onto the wire. Rotary impeller means provided in the housing is operative to distribute the fibers over the screen to achieve uniform deposition of fibers on the forming wire.

Apparatus comprising multiple impellers rotatable about vertical axes and disposed in side-by-side relation above a planar screen extending over the forming wire are found in the art, but have a disadvantage in that spaces between the impellers contribute to variations in flow of the fibers through the screen, thereby detracting from uniformity of web formation in its cross machine direction.

Impellers rotatable about horizontal axes parallel to the plane of the forming wire, and extending transversely of the direction of wire movement, have been used in combination with a cylindrically shaped screen to improve web formation in its cross machine direction. Difficulties are still encountered, however, since the impeller blades extend parallel to their rotational axes, and there is often random motion of fibers in the housing in a cross machine direction tending to detract from uniformity of web formation.

U.S. Patents exemplary of the hereinabove described prior art are identified and briefly described in what follows:

U.S. Pat. No. 2,931,076 discloses apparatus for forming webs by dry-laying fibers from a dispensing chamber 15 through a foraminous, semi-cylindrical separating wall 16 onto a foraminous collecting wall 21, a series of disintegrating blades 18 being mounted for rotation about the axes of wall 16, transversely of the direction of movement of collecting wall 21; U.S. Pat. No. 3,644,078 discloses apparatus for dry-forming webs including multiple rotational elements 80, 81 above a screen 75 wherein the elements are in parallel array extending transversely of the direction of movement of forming wire 85;

U.S. Pat. No. 4,335,066 discloses impellers rotatable about vertical axes and in side-by-side relation to create a racetrack pattern of fibers caused to pass through a screen constructed to provide uniform distribution.

U.S. Pat. No. 4,264,289 discloses impellers similar to those of the '066 patent, and a screen construction for ensuring uniform fiber distribution; and U.S. Pat. Nos. 4,169,699, 4,144,619, 3,984,898, and 3,645,457 disclose further examples of fiber distributors, each having a rotational element arranged to rotate about an axis parallel to a forming wire and extending transversely of the direction of movement of the wire.

None of the hereinabove described patents directed to horizontally rotational impellers suggests helical blading for the impellers.

It is a general objective of the invention to provide an improved distributor construction including helically bladed impellers for uniformly depositing dry-fibers on a forming wire in formation of a web of uniform thickness.

It is a further and specific objective of the invention to provide an improved dry-fiber distributor apparatus including a horizontal axis, rotational impeller having helical blades in novel cooperative disposition with respect to an impeller housing and a cylindrically-shaped screen extending over its outlet opening for achieving uniform fiber distribution on a forming wire.

SUMMARY OF THE INVENTION

In achievement of the foregoing general objectives, the invention contemplates an apparatus for depositing a uniform web of dry fibers on a moving forming wire, comprising:

a fiber distributor housing having upper and lower wall sections of generally semi-cylindrical shape and end walls extending transversely thereof, said walls being cooperatively disposed to define a generally cylindrical chamber having its axis of curvature extending transversely of the direction of movement of said wire;

said lower wall section comprising means defining a screen disposed above said forming wire for accommodating passage of fiber therethrough;

means defining an elongate opening in said upper wall and extending in the direction of its axis for introducing dry fibers into said chamber; and a rotor having an axis of rotation substantially coextensive with the axis of curvature said chamber, said rotor including at least a pair of oppositely disposed rotor blades equidistant from the axis rotation and extending helically between said end walls at predetermined pitch angles, whereby air-entrained fibers introduced into said chamber through said opening upon rotation of said rotor are caused by said helical rotor blades to move axially of said chamber, in achievement of uniform distribution of said fibers in cross machine direction, while said fibers are being moved radially outwardly of said rotor for passage through said screen.

The manner in which the objectives of the invention may best be achieved will be more fully understood from a consideration of the following description, taken in light of the accompanying drawing.

BRIEF DESCRIPTION OF THE DRAWING

FIG. 1 is a fragmented side elevational view, partly in section, of one embodiment of an apparatus for depositing dry fibers on a forming wire in the manufacture of a fibrous web;

FIG. 2 is a fragmented top plan view of the apparatus shown in FIG. 1;

FIG. 3 is a fragmented perspective view of the apparatus seen in FIGS. 1 and 2;

DETAILED DESCRIPTION OF THE EMBODIMENTS OF THE INVENTION

Figure 4:
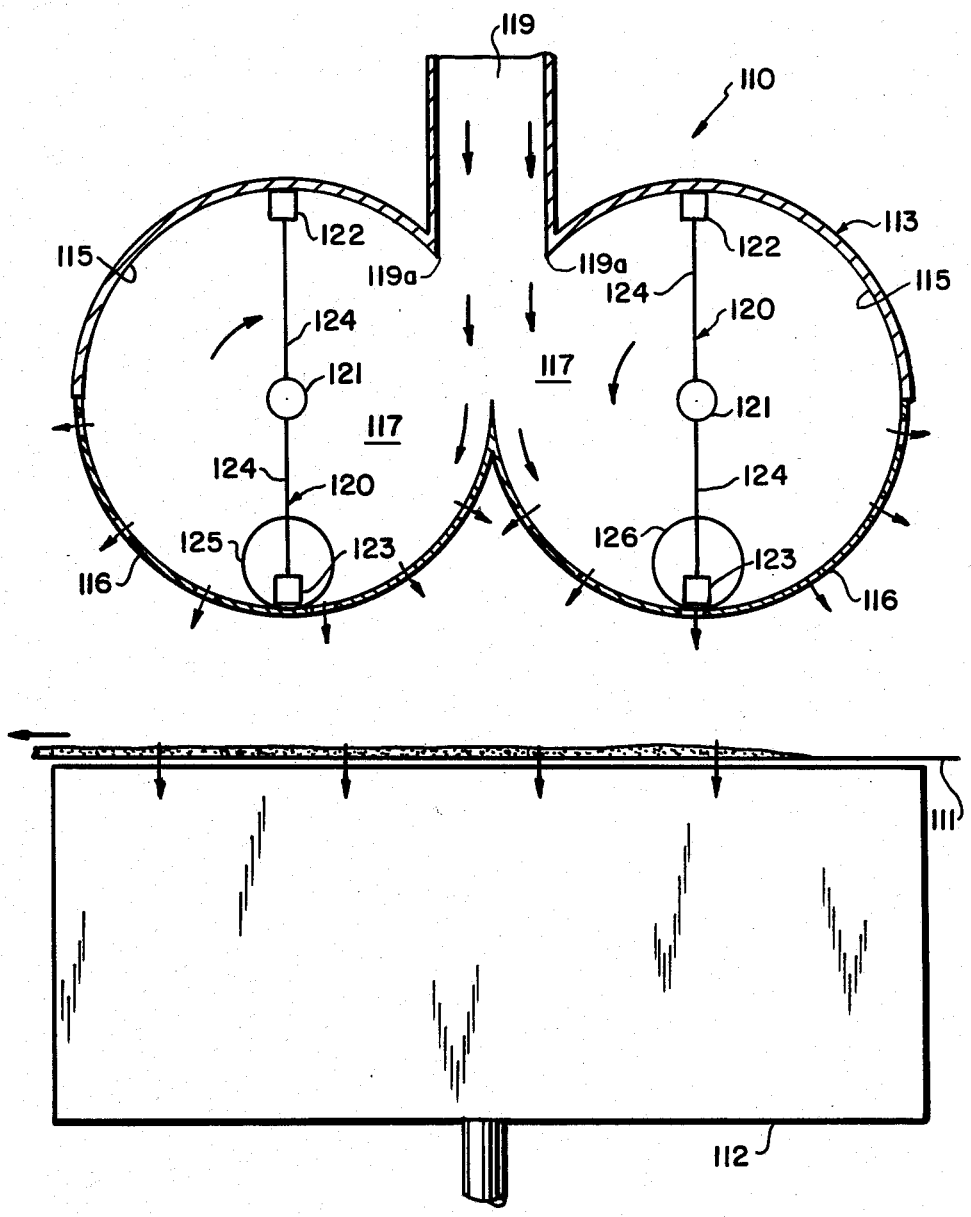
FIGS. 4 and 5, though partially diagrammatic are views generally similar to FIGS. 1 and 2, and illustrate another embodiment of the invention.

With more detailed reference to the drawing, in FIGS. 1 and 2 apparatus 10 comprises a forming wire 11 linearly movable from right to left over a suction box 12 (FIG. 1). There is disposed above wire 11 a dry fiber distributor 13 comprising a housing defined by upper and lower generally semicylindrical wall sections 15 and 16, respectively, and end walls 17 and 18 cooperatively disposed to form a generally cylindrical chamber. Lower wall section 16 comprises a screen in the form of a wire mesh, or a foraminous plate as shown disposed above forming wire 11 for accommodating passage of fiber therethrough for deposition on wire 11.

With reference also to FIG. 3, an elongate duct-like opening 19 is provided in upper wall 15, extending in the direction of and substantially parallel to its axis of curvature. A rotor 20 is disposed in the housing and includes a rotor shaft 21 having its axis of rotation substantially coextensive with the axis of curvature of the housing. Rotor 20 includes a pair of oppositely disposed rotor blades or bars 22 and 23 suitably supported on spokes 24. Blades 22 and 23 are equidistant from the axis of rotation and extend helically through a predetermined angle, for example 180°, between end walls 17 and 18 on which the rotor shaft 21 conveniently is mounted for rotation by suitable drive means (not shown).

In operation of the apparatus thus far described in connection with FIGS. 1 2, and 3, air entrained fibers are introduced from a suitable source into the housing through opening 19, in upper wall 15, as rotor 20 is turned in a clockwise direction and wire 11 is moved from right to left. Due to the helical blading of rotor 20, the fibers are caused to be spread uniformly over screen 16, axially of the housing as well as radially outwardly through the screen onto forming wire 11. The rate of axial movement can be optimized by selecting a rotational speed of the rotor effective also to achieve relatively high fiber throughput for deposit in a uniform web on forming wire 11.

With reference to FIGS. 4, 5, 6, and 7, another embodiment of the invention achieves still further advantages through a tandem arrangement of rotors and housings of the type hereinabove described. More particularly, apparatus 110 includes a forming wire 111 and a suction box 112 as hereinabove described, and a dry fiber distributor 113 comprising a tandem array, with respect to the machine direction, of housings of like elements, each defined by an upper cylindrically curved wall 115, a lower cylindrically curved wall 116, and end walls 117, 118.

Walls 115, 116, 117, and 118 of each housing are cooperatively disposed to form a cylindrical chamber, each being adjacent to the other, for example along a line of tangency lying generally in the horizontal plane of their center lines. Each of the lower walls 116 comprises a screen in the form of a wire mesh or a foraminous plate as shown through which fibers may be discharged onto forming wire 111. Further to distributor 113, each chamber is provided with an elongate, horizontally extending opening 119*a* just above the line of tangency, and in air flow communication with a common elongate inlet passage 119 for introducing into the tandem chambers a suspension of web-forming fibers in air.

Like rotors 120 are disposed in the chamber of each housing and each comprises a shaft 121 mounted for rotation on opposed end walls 117, 118. Each rotor 120 further comprises spokes 124 positioned on shaft 121 and adapted to support helical rotor bars or blades 122, 123.

Suitable known drive means (not shown) are provided for the rotors 120 and the forming wire 111. In operation of rotors 120 by their drive means, and as viewed somewhat diagrammatically in FIG. 4, the left hand rotor 120 is rotated in a right hand direction and the right hand rotor 120 is rotated in the left hand direction. The result is that the rotor blades 122, 123 are driven downwardly directly below inlet passage 119*a* and across their respective screens 116 in opposite directions.

Counterrotation of the rotors will be more fully appreciated taking into account further construction of the distributor, wherein the end walls 117, 118 of housing 114 are spaced from the ends of rotor blades 122, 123. As with the other embodiment, rotor shafts 121 are supported in the end walls 117, 118 on suitable bearing means. In provision of communicating air passageways between the chambers, adjacent ones of each of these same end walls includes a pair of air-fiber flow ports 125, 126 connected to conduits 127, 128 that lead to an air impeller means comprising a scroll housing 129 having an impeller wheel 130 rotatable therein by a suitable drive 131. In effect, conduit 127 is an inlet and conduit 128 is an outlet for scroll 129. Also, there is a fiber clump recycle conduit 132 connected to a lower region of each scroll housing 129 and leading to a suitable fiber clump recycling station (not shown).

Figure 5:
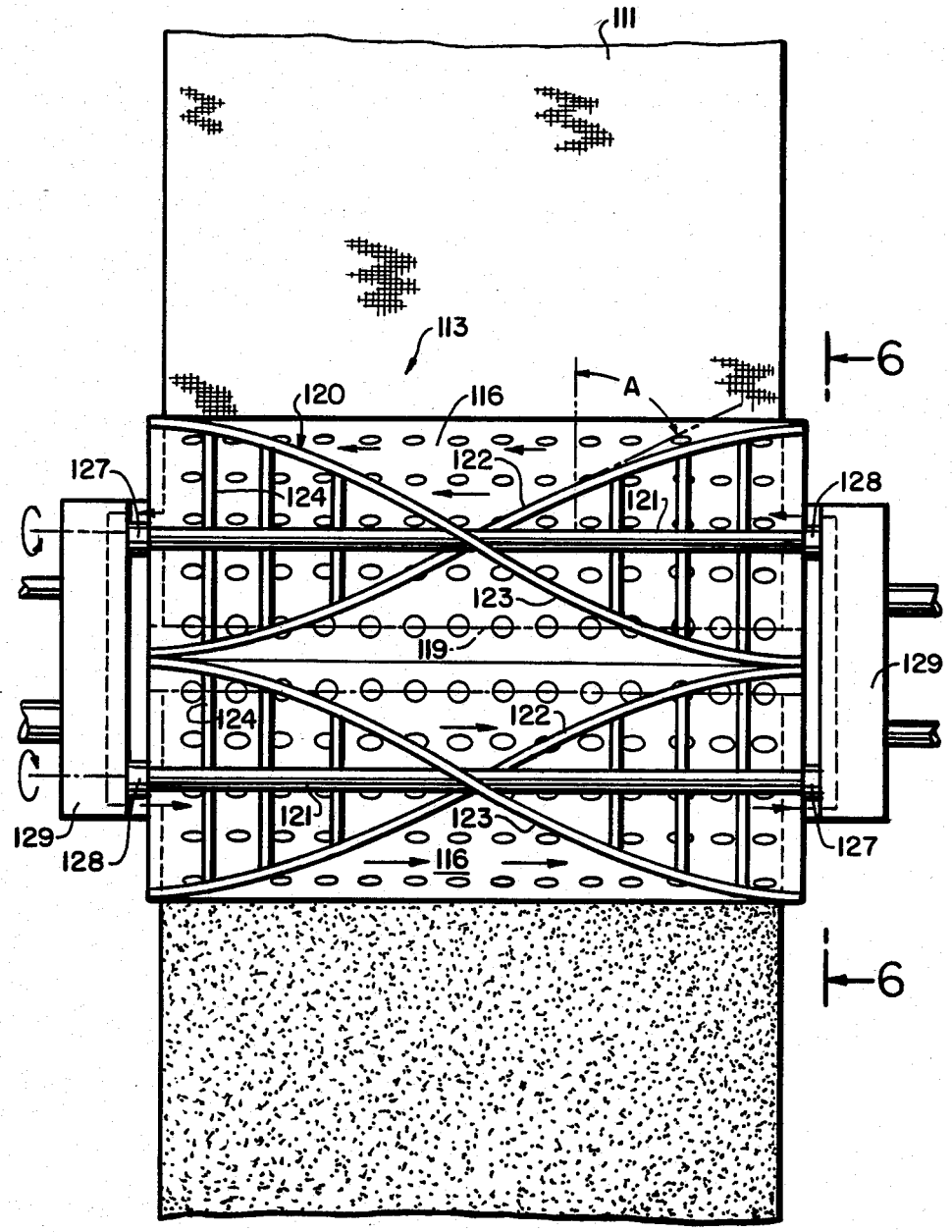
Figure 6:
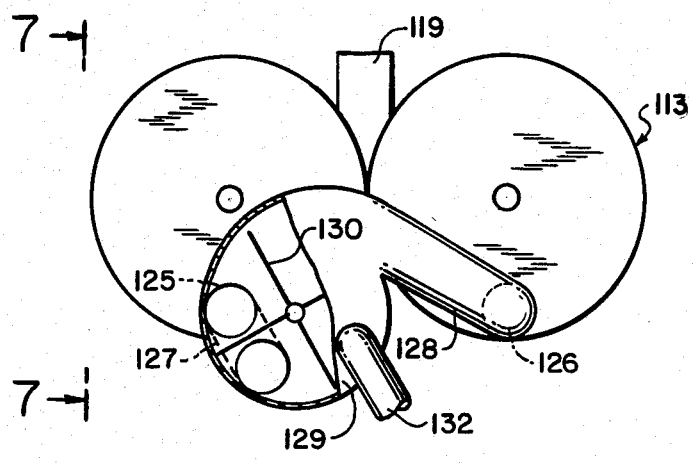
FIG. 6 is a fragmented elevational view of the apparatus seen in FIG. 5, looking in the direction of arrows 6—6 applied thereto.
Figure 7:
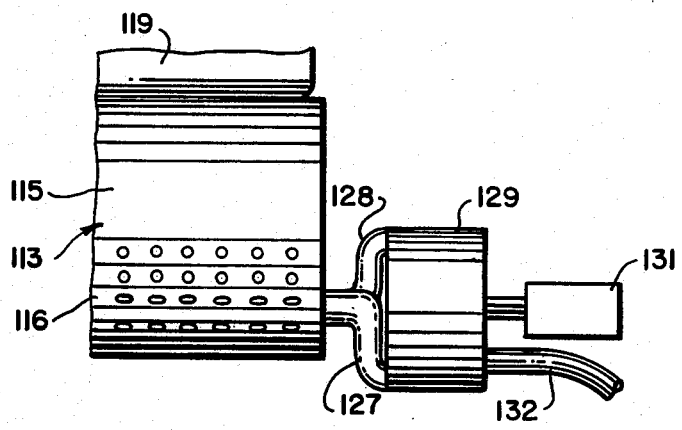
FIG. 7 is a fragmented elevational view of the apparatus seen in FIG. 6, looking in the direction of arrows 7—7 applied thereto.

In operation of the apparatus described in connection with FIGS. 4 to 7, as a suspension of fibers in air is introduced into inlet 119, and as the rotors 120 are rotated as hereinabove described, axially flowing air currents are set up in the chambers in accordance with the directional arrows applied to the interior of the tandem arranged chambers as shown in FIG. 5. These air currents are set up by the pumping action of the helical rotor blades in combination with the spaces between the rotors and the end walls, and in further combination with the pumping action of impeller wheel 130, these same air currents create a "racetrack" for the fibers ensuring their uniform distribution across the screen 116.

In maintaining the racetrack, air and fibers moving axially of the one housing 114 are drawn out of port 125 through conduit 127 into scroll 129, thence caused to flow through conduit 128 and port 126 into the other housing 114. By virtue of the downward extension of conduit 128 to a lower portion of scroll 129, and the downward extension of conduit 127 from an upper portion of the scroll, any heavy clumps of fibers will gravitate in the scroll and will be discharged through downwardly extending recycle conduit 132.

For either embodiment, and by way of example, a pitch angle as indicated at A in FIG. 5 has been selected for a rotor blade or bar which for the cylindrical radius affords a half pitch extension of the bar across the width of the distributor chamber. Accordingly, for each full revolution of a rotor, a blade effectively wipes the width chamber twice, and with paired blades on each rotor, a positive movement of fibers in the cross machine direction is achieved. This cross flow ensures uniformity of deposition across the forming wire, in the cross machine direction (CD).

In either of the embodiments, it will be understood that the pitch angles and rotational speeds are selected to afford an optimum uniformity of fiber distribution and rate of throughput. For a given rotational speed to achieve an optimum throughput, lower pitch angles increase the lateral motion whereas higher pitch angles decrease lateral motion. While the present invention is not confined to particular pitch angles or rotational speeds, it is in order to note that rotor speeds may be in a range from about 60 to about 1200 RPM, rotor diameters may be in a range from about 12 to about 36 inches, with pitch angles in a range from about 60 to about 85°.

It will therefore be appreciated that for a given width of forming wire, a rotor blade having a low pitch angle for a specified rotational speed would afford greater lateral motion and lesser rotational motion of fibers than would a rotor blade having higher pitch angles. In other words, a lower pitch angle increases the ratio of lateral motion to rotational motion of the fibers.

While a pair of embodiments have been described, it will be appreciated that the invention is susceptible of such modifications as may fall within the scope of the appended claims.

I claim:

1. An apparatus for depositing a uniform web of dry fibers on a moving forming wire, comprising:

a fiber distributor housing having upper and lower wall sections of generally semi-cylindrical shape and end walls extending transversely thereof, said walls being cooperatively disposed to define a generally cylindrical chamber having its axis of curvature extending transversely of the direction of movement of said wire, said lower wall section comprising means defining a screen disposed above said forming wire for accommodating passage of fiber therethrough:

means defining an elongate opening in said upper wall and extending in the direction of its axis of curvature for introducing air-entrained dry fibers into said chamber; and a rotor having an axis of rotation substantially coextensive with the axis of curvature said chamber, said rotor including a plurality of substantially equally angularly spaced helical rotor blades, said rotor blades being spaced equidistant from the axis of rotation and extending between said end walls in close proximity to said lower and upper wall sections, whereby upon rotation of said rotor, air-entrained fibers introduced into said chamber through said opening are caused by said helical rotor blades to move axially of said chamber, uniformly to distribute said fibers in cross machine direction, while said fibers are being moved radially outwardly of said rotor for passage through said screen.

2. An apparatus for depositing a uniform web of dry fibers on a moving forming wire, comprising:

a dry fiber distributor comprising a tandem array, with respect to the direction of wire movement, of a pair of housings, each said housing having upper and lower cyclindrically curved walls and end walls extending transversely thereof, said walls of each said housing being cooperatively disposed to form a generally cylindrical chamber having its axis of curvature extending transversely of the direction of movement of said forming wire;

each said chamber being substantially tangent to the other along a line in the horizontal plane of their axes of curvature, each said lower wall comprising a screen through which fibers may be discharged onto the forming wire;

each said chamber having an elongate, horizontally extending opening in its upper curved wall in the region of the line of tangency of said chambers;

means defining an elongate inlet passage communicating with said openings for introducing into said tandem chambers a suspension of web-forming fibers in air;

a rotor in each said chamber comprising a shaft mounted for rotation therein, each said rotor comprising means on said shaft supporting a plurality of substantially equally angularly spaced helical rotor blades equidistant from said shaft and extending between said end walls about said shaft at uniform pitch angles, said rotor blades being spaced in close proximity to said upper and lower walls; and means for driving said rotors simultaneously for rotation in opposite directions such that the rotor blades move downwardly in the regions of said elongate openings, whereby air and fibers are drawn into said chambers effecting both axial movement of said fibers in opposite cross machine directions by said counterrotating rotors and centrifugal discharge through said screens onto said forming wire.

3. the apparatus of claim 2, wherein each said end wall includes a port in loser region thereof adjacent the screen and the ends of said rotor blades, whereby fibers moved axially to said end wall by said rotor blades are discharged from said housing through said port, and air impeller means defining communicating air passageways between said ports in the end walls of said chambers, whereby said fibers discharged through a port at the end wall of one said housing are introduced into the other said housing, said rotating blades and said impeller means cooperating to maintain a recirculating elliptical air flow path within and between said chambers.

4. The apparatus of claim 2, wherein the pitch angle of said helical rotor blades is in the range of from about 60° to about 85°.

5. The apparatus of claim 3, wherein each said air impeller means comprises a scroll housing, an impeller wheel therein and air-fiber flow conduits connecting a lower region of each said scroll with said ports, and means in air-fiber flow communication with a lower region of each said scroll for receiving fiber clumps for recycling.

6. The apparatus of claim 2, including means defining communicating air passageways between adjacent end walls of said housings, whereby a racetrack air-flow path is established within and between said chambers.

* * * * *